US012415691B2

(12) United States Patent
Ishii

(10) Patent No.: US 12,415,691 B2
(45) Date of Patent: Sep. 16, 2025

(54) SHEET FEEDING DEVICE AND IMAGE FORMING APPARATUS INCLUDING SAME

(71) Applicant: KYOCERA Document Solutions Inc., Osaka (JP)

(72) Inventor: Akira Ishii, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 83 days.

(21) Appl. No.: 18/605,350

(22) Filed: Mar. 14, 2024

(65) Prior Publication Data

US 2024/0317519 A1 Sep. 26, 2024

(30) Foreign Application Priority Data

Mar. 24, 2023 (JP) ..... 2023-047619

(51) Int. Cl.
*B65H 1/26* (2006.01)
*B65H 3/06* (2006.01)
*B65H 3/52* (2006.01)

(52) U.S. Cl.
CPC ..... *B65H 1/266* (2013.01); *B65H 3/0638* (2013.01); *B65H 3/0684* (2013.01); *B65H 3/5215* (2013.01); *B65H 3/5261* (2013.01); *B65H 2404/1521* (2013.01)

(58) Field of Classification Search
CPC .... B65H 1/266; B65H 3/0638; B65H 3/0684; B65H 3/5215; B65H 3/5261; B65H 2404/1521
See application file for complete search history.

(56) References Cited

U.S. PATENT DOCUMENTS

2010/0133739 A1* 6/2010 Shiraishi ..... B65H 3/5215 271/10.11
2012/0126475 A1* 5/2012 Shin ..... B65H 1/266 271/226
2019/0077621 A1* 3/2019 Kato ..... B65H 3/5261

FOREIGN PATENT DOCUMENTS

JP 2002-205832 A 7/2002
JP 2002293444 A * 10/2002

* cited by examiner

*Primary Examiner* — Prasad V Gokhale
(74) *Attorney, Agent, or Firm* — Stein IP, LLC

(57) ABSTRACT

A sheet feeding device includes a cassette storage part, a sheet feed cassette, a pickup roller, a feed roller, a retard roller, a retaining member, and a pushing mechanism. The pushing mechanism pushes the retaining member so that the retard roller is pushed to contact with the feed roller. The pushing mechanism includes a pushing member that contacts and pushes the retaining member, and a biasing member that biases the pushing member. In a plane perpendicular to a rotation shaft of the retard roller, a pushing direction of the pushing member in a push contact position against the retaining member forms an angle of 45 degrees or less, with a straight line connecting the center of the rotation shaft of the retard roller and the center of a rotation shaft of the feed roller.

4 Claims, 4 Drawing Sheets

SHEET FEEDING DEVICE AND IMAGE FORMING APPARATUS INCLUDING SAME

INCORPORATION BY REFERENCE

This application is based upon and claims the benefit of priority from the corresponding Japanese Patent Application No. 2023-047619 filed Mar. 24, 2023, the entire contents of which are hereby incorporated by reference.

BACKGROUND

The present disclosure relates to a sheet feeding device and an image forming apparatus including the same.

A conventional sheet feeding device is disclosed in Patent Document 1. This sheet feeding device includes a cassette storage part, a sheet feed cassette, a pickup roller, a feed roller, a retard roller, a retaining member, and a pushing member.

The sheet feed cassette stores sheets and is mounted to the cassette storage part in an attachable and detachable manner. The pickup roller contacts with the sheet stored in the sheet feed cassette so as to send out the sheet. The feed roller conveys the sheet sent out by the pickup roller. The retard roller is pushed to contact with the feed roller to form a nip part, so as to convey the sheet while separating the sheets. If the pickup roller sends out a plurality of sheets at one time, the feed roller and the retard roller feeds only the top sheet by separating the sheets.

The retaining member retains the retard roller so that the retard roller can contact or separate from the feed roller. The pushing member pushes the retaining member so that the retard roller is pushed to contact with the feed roller. The retaining member is supported in a rockable manner about a rocking axis. Further, in a state where the sheet feed cassette is drawn out from the cassette storage part, the retaining member rocks and moves to a retract position where the retard roller is separated from the feed roller. In addition, in a state where the sheet feed cassette is mounted to the cassette storage part, the retaining member rocks and moves to a push contact position where the pushing member allows the retard roller to be pushed to contact with the feed roller.

When adopting the conventional technique, the pushing of the pushing member against the retaining member may not be stable, and the push contact force of the retard roller against the feed roller may be unstable. If the push contact force of the retard roller against the feed roller is large, double sheet feeding may occur. In addition, if the push contact force of the retard roller against the feed roller is small, a sheet feed error may occur.

SUMMARY

A sheet feeding device according to one aspect of the present disclosure includes a cassette storage part, a sheet feed cassette, a pickup roller, a feed roller, a retard roller, a retaining member, and a pushing mechanism. The sheet feed cassette is mounted to the cassette storage part in an attachable and detachable manner. The pickup roller contacts with a sheet stored in the sheet feed cassette so as to send out the sheet. The feed roller conveys the sheet sent out by the pickup roller. The retard roller is pushed to contact with the feed roller so as to form a nip part, and conveys the sheet while separating the sheets. The retaining member retains the retard roller so that the retard roller can contact or separate from the feed roller. The pushing mechanism pushes the retaining member so that the retard roller is pushed to contact with the feed roller. The retaining member is supported in a rockable manner about a rocking axis extending in parallel to a rotation shaft of the retard roller. In a state where the sheet feed cassette is drawn out from the cassette storage part, the retaining member is positioned at a retract position where the retard roller is separated from the feed roller. In a state where the sheet feed cassette is mounted to the cassette storage part, the retaining member is positioned at a push contact position where the pushing mechanism allows the retard roller to be pushed to contact with the feed roller. The pushing mechanism includes a pushing member that contacts and pushes the retaining member, and a first biasing member that biases the pushing member. In a plane perpendicular to the rotation shaft of the retard roller, a pushing direction of the pushing member in the push contact position against the retaining member forms an angle of 45 degrees or less, with a straight line connecting the center of the rotation shaft of the retard roller and the center of a rotation shaft of the feed roller.

Other objects of the present disclosure and specific advantages obtained by the present disclosure will become more apparent from the description of the embodiment given below.

DETAILED DESCRIPTION

Figure 1:
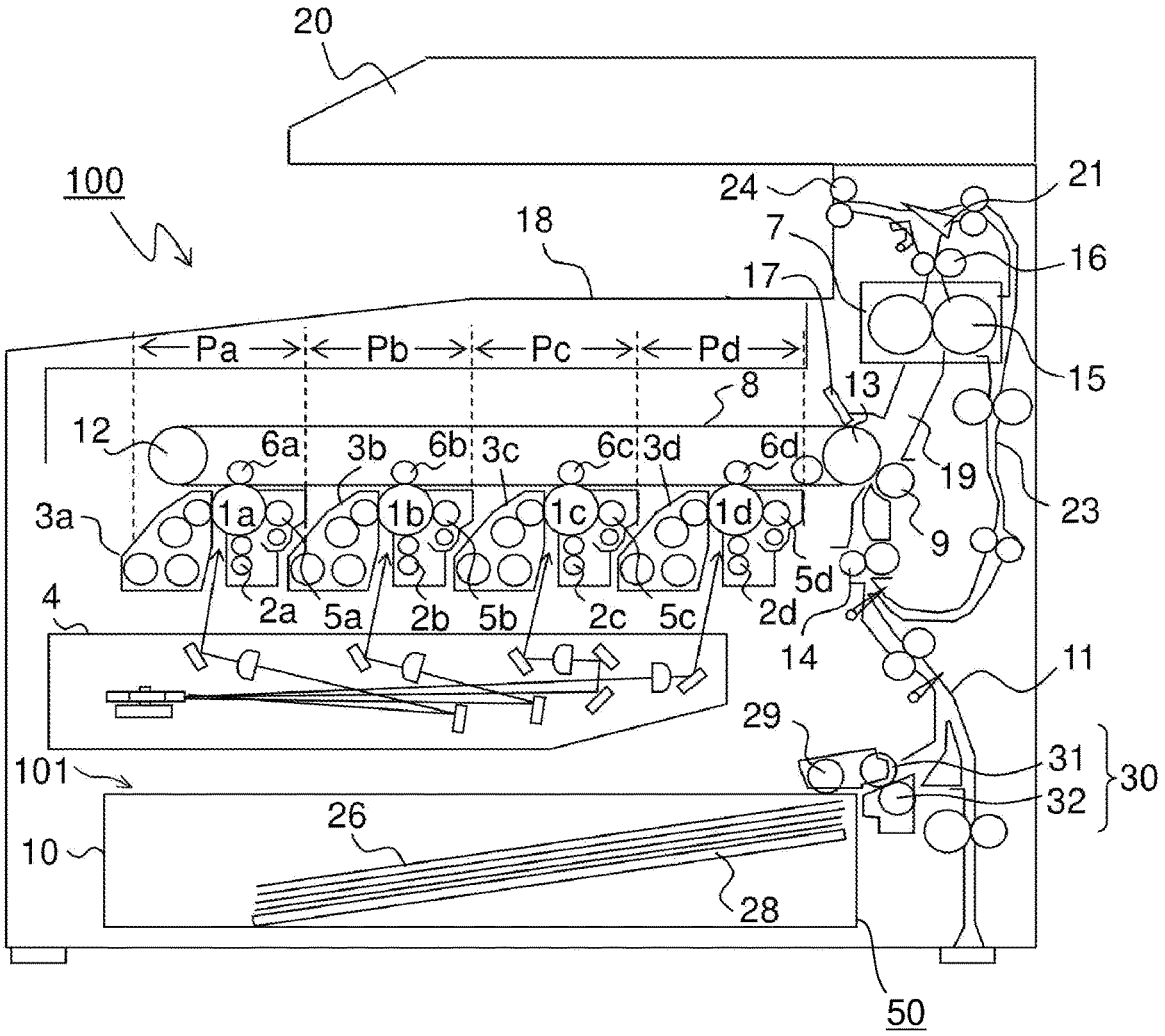
FIG. 1 is a cross-sectional view illustrating an overall structure of an image forming apparatus 100 including a sheet feeding device 50 according to one embodiment of the present disclosure.

Hereinafter, an embodiment of the present disclosure is described with reference to the drawings. FIG. 1 is a cross-sectional view illustrating an overall structure of an image forming apparatus 100 including a sheet feeding device 50 of the present disclosure.

The image forming apparatus 100 is a tandem type color copier, and four image forming units Pa, Pb, Pc, and Pd are disposed in a main body of the image forming apparatus 100, in order from the left in FIG. 1. The image forming units Pa to Pd are disposed corresponding to four images of different colors (yellow, magenta, cyan, and black), and they sequentially form yellow, magenta, cyan, and black images by steps of charging, exposing, developing, and transferring.

The image forming units Pa to Pd respectively include photosensitive drums 1*a*, 1*b*, 1*c*, and 1*d* for carrying individual color visual images (toner images). In addition, an intermediate transfer belt 8 that rotates in a counterclockwise direction is disposed adjacent to the image forming units Pa to Pd. The toner images formed respectively on the photosensitive drums 1*a* to 1*d* are sequentially transferred and overlaid onto the intermediate transfer belt 8 that moves while contacting the photosensitive drums 1*a* to 1*d*.

After that, the toner images are transferred onto a sheet 26 such as a paper sheet by action of a secondary transfer roller 9. Further, the toner images are fixed onto the sheet 26 in a fixing device 7, and then the sheet is discharged from the main body of the image forming apparatus 100. The photosensitive drums 1*a* to 1*d* rotate in a clockwise direction in FIG. 1, while image forming processes are performed on the photosensitive drums 1*a* to 1*d*.

A cassette storage part 101 is disposed in a lower part of the main body of the image forming apparatus 100. A sheet feed cassette 10 that stores the sheets 26 is mounted to the cassette storage part 101 in an attachable and detachable manner. The sheet feed cassette 10 is attached or detached from the front of the main body of the image forming apparatus 100 (the front side of the paper of FIG. 1).

The sheets 26 are loaded on a sheet loading plate 28 of the sheet feed cassette 10. A pickup roller 29 is pushed to contact with the top surface of the sheet 26 at a predetermined pressure. When the pickup roller 29 is rotated, feeding of the sheet 26 is started. Out of the fed sheets 26, the top sheet 26 is separated by a feed roller pair 30 and is conveys to a sheet conveying path 11. The sheet 26 after passing the sheet conveying path 11 reaches a registration roller pair 14, and is conveyed to a nip part between the secondary transfer roller 9 and a drive roller 13 of the intermediate transfer belt 8, in synchronization with image formation timing.

A dielectric resin sheet is used for the intermediate transfer belt 8, and a seamless belt is mainly used for the same. In addition, on a downstream side of the secondary transfer roller 9 in the moving direction of the intermediate transfer belt 8, there is disposed a cleaning blade 17 for removing toner remaining on a surface of the intermediate transfer belt 8.

An image reading unit 20 is disposed in an upper part of the main body of the image forming apparatus 100, and reads an original image so as to convert it into image data when performing copying.

Next, the image forming units Pa to Pd are described. Around and below the photosensitive drums 1*a* to 1*d*, there are disposed charging devices 2*a*, 2*b*, 2*c*, and 2*d*, an exposing device 4, developing devices 3*a*, 3*b*, 3*c*, and 3*d*, and cleaning devices 5*a*, 5*b*, 5*c*, and 5*d*.

When image data is input from the image reading unit 20, the charging devices 2*a* to 2*d* charge surfaces of the photosensitive drums 1*a* to 1*d* uniformly first. Next, the exposing device 4 emits light beams so as to form electrostatic latent images on the photosensitive drums 1*a* to 1*d*, respectively, corresponding to the image data. The developing devices 3*a* to 3*d* have developing rollers (developer carriers) disposed to face the photosensitive drums 1*a* to 1*d*, respectively. The developing devices 3*a* to 3*d* are filled with predetermined amounts of two-component developer including toner of yellow, magenta, cyan, and black colors, respectively. The toner is supplied from the developing rollers onto the photosensitive drums 1*a* to 1*d*, respectively, and toner images corresponding to the electrostatic latent images are formed.

The toner images on the photosensitive drums 1*a* to 1*d* are primarily transferred onto the intermediate transfer belt 8. After that, the toner remaining on the photosensitive drums 1*a* to 1*d* are removed by the cleaning devices 5*a* to 5*d*.

The intermediate transfer belt 8 is wrapped around a driven roller 12 and the drive roller 13. When the drive roller 13 rotates, the intermediate transfer belt 8 starts to rotate in the counterclockwise direction. At this time, the sheet 26 is conveyed from the registration roller pair 14 to a nip part (secondary transfer nip part) between the secondary transfer roller 9 and the intermediate transfer belt 8, at a predetermined timing. At the nip part, the full color image is secondarily transferred onto the sheet 26.

The sheet 26 is conveyed to the fixing device 7, and it is heated and pressed when passing through a nip part (fixing nip part) of a fixing roller pair 15, so that the toner image is fixed to a surface of the sheet 26 and that the predetermined full color image is formed. After that, the sheet 26 passes a conveying roller pair 16, and the conveying direction thereof is selected by a conveyance guide member 21 disposed at a branch part of a sheet conveying path 19. Then, the sheet 26 is discharged onto a discharge tray 18 via a discharge roller pair 24 as it is (or after being sent to a double-sided conveying path 23 and after double-sided copying).

The sheet conveying path 19 is configured to connect to the discharge tray 18 or the double-sided conveying path 23, on the downstream side of the conveying roller pair 16.

Figure 2:
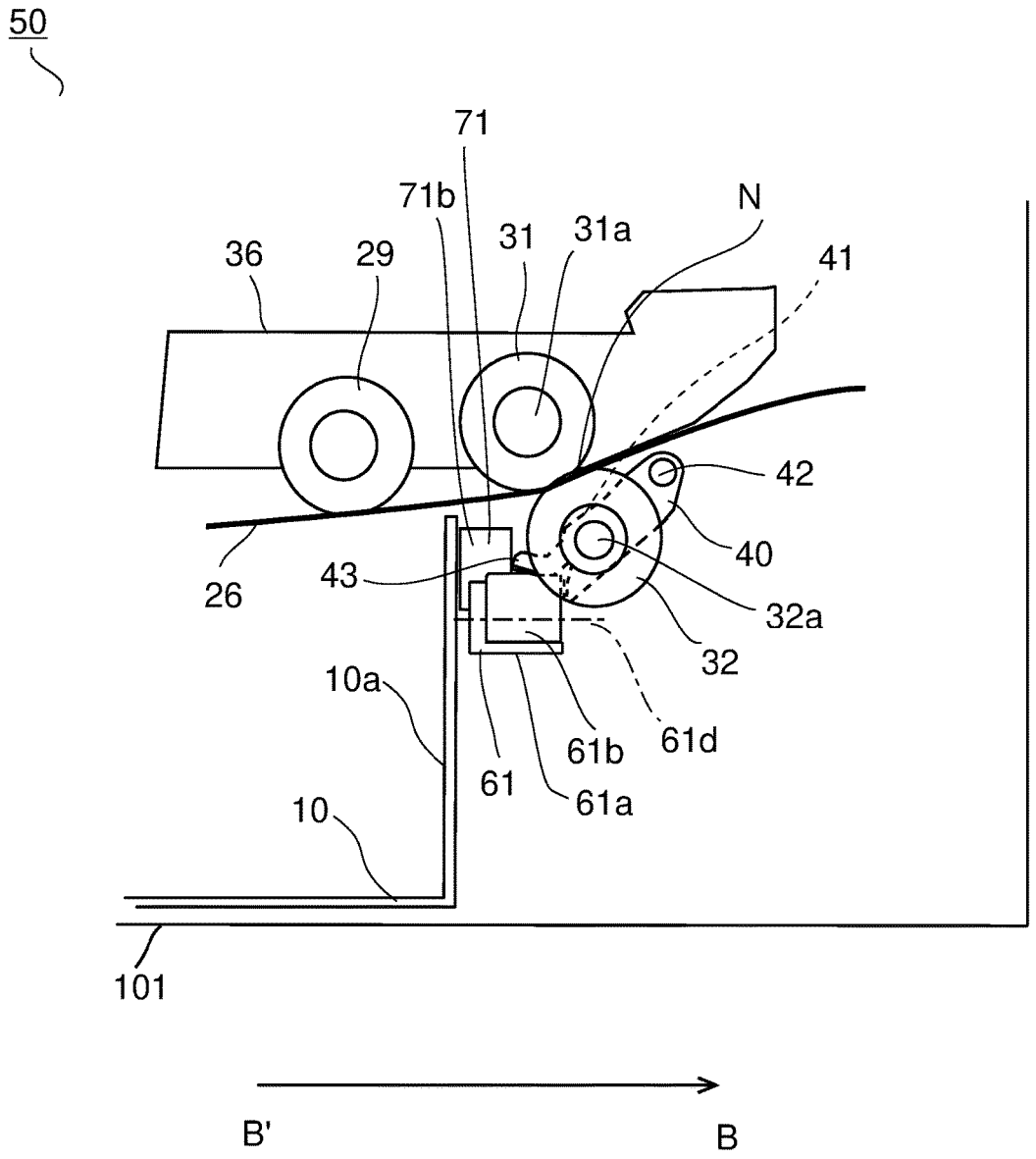
FIG. 2 is a schematic cross-sectional view illustrating a structure of the sheet feeding device 50 and its vicinity according to one embodiment of the present disclosure.
Figure 3:
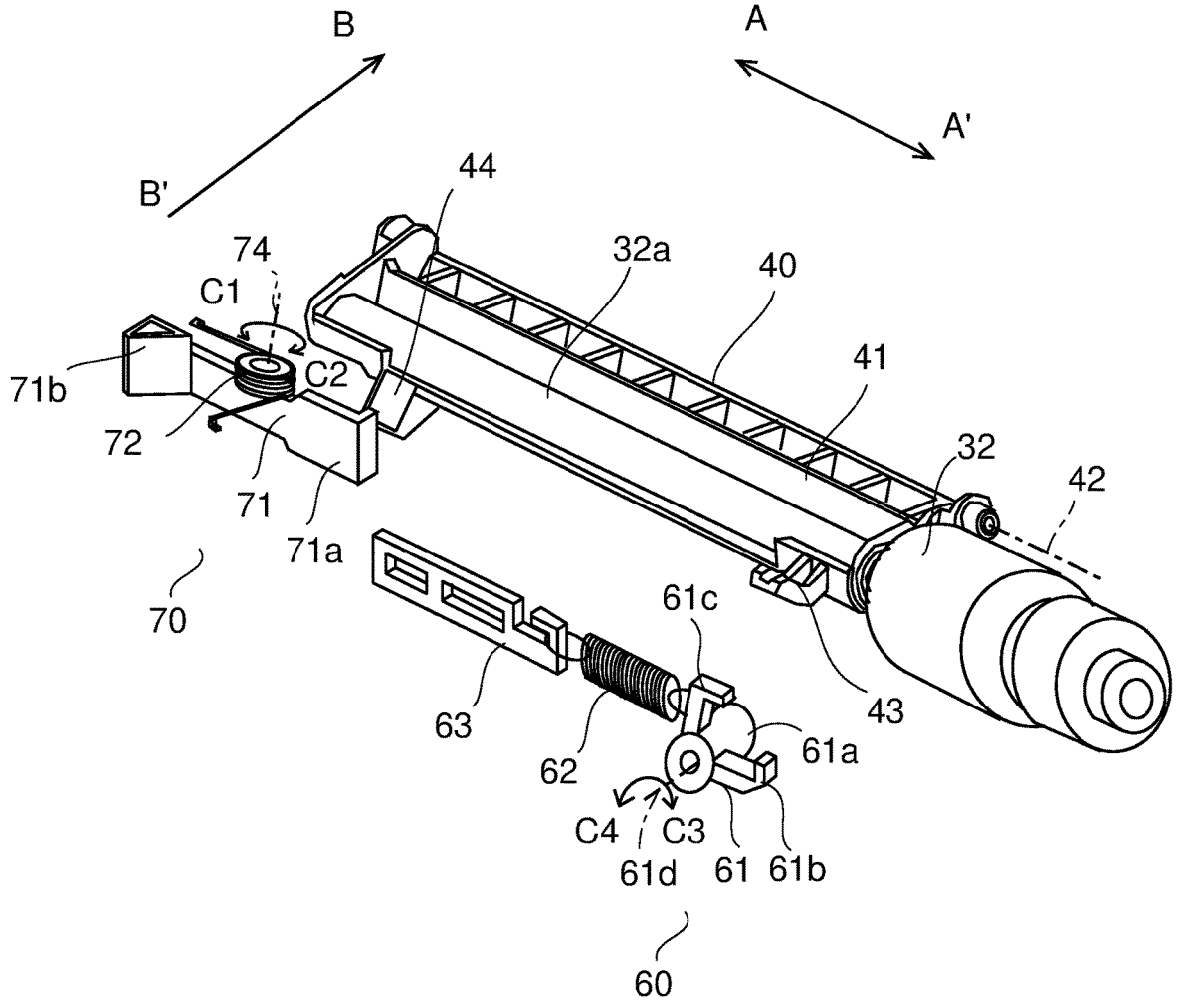
FIG. 3 is an exploded perspective view illustrating a structure of a retard roller 32, a pushing mechanism 60, and their vicinity of the sheet feeding device 50 according to one embodiment of the present disclosure.
Figure 4:
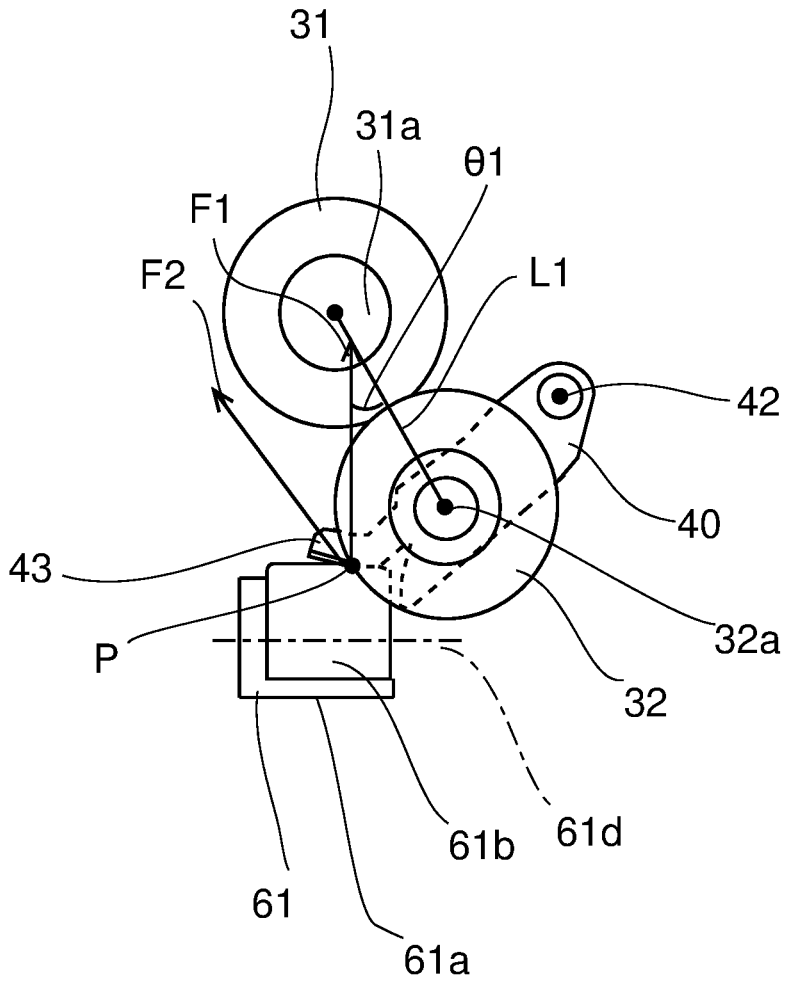
FIG. 4 is an explanatory diagram for describing an operation of the pushing mechanism 60 of the sheet feeding device 50 according to one embodiment of the present disclosure.

Next, a structure of the pickup roller 29 and its vicinity is described. FIG. 2 is a schematic cross-sectional view illustrating a structure of the sheet feeding device 50 and its vicinity, in which a cross section perpendicular to a rotation shaft 32*a* of a retard roller 32 is illustrated. FIG. 3 is an exploded perspective view illustrating a structure of the retard roller 32, a pushing mechanism 60, and their vicinity. FIG. 4 is an explanatory diagram for describing an operation of a retaining member 40, in which a cross section perpendicular to the rotation shaft 32*a* of the retard roller 32 is illustrated. In addition, in FIGS. 2 and 4, the retard roller 32 is in a push contact position where it is pushed to contact with a feed roller 31.

The sheet feeding device 50 supplies the sheet 26 to the sheet conveying path 11, and it includes the cassette storage part 101, the sheet feed cassette 10, the pickup roller 29, the feed roller 31, the retard roller 32, a roller retaining member 36, the retaining member 40, the pushing mechanism 60, and a separation mechanism 70.

The pickup roller 29 contacts with the sheet 26 stored in the sheet feed cassette 10 and sends out the sheet 26.

The feed roller 31 conveys the sheet 26 sent out by the pickup roller 29. The pickup roller 29 and the feed roller 31 are retained by the roller retaining member 36 in a rotatable manner. The feed roller 31 is attached to a rotation shaft 31*a* connected to a not shown drive motor (drive source), and is rotated by a drive force from the drive motor. Between the feed roller 31 and the pickup roller 29, there is a drive force transmission gear (not shown) that transmits rotation of the feed roller 31 to the pickup roller 29.

The retard roller 32 is pushed to contact with the feed roller 31 to form a nip part N, so as to convey the sheet 26 while separating the sheets 26. The retard roller 32 is pushed to contact with the feed roller 31 and is driven to rotate. If a plurality of the sheets 26 are simultaneously fed by the pickup roller 29, the sheets 26 are separated by the feed roller 31 and the retard roller 32, and only the top sheet is conveyed to the sheet conveying path 11.

The retaining member 40 supports the retard roller 32 in a rotatable manner. In this embodiment, the retaining member 40 includes a semi-cylindrical housing part 41 extending in an axial direction of the retard roller 32, a first pushed piece 43, and a second pushed piece 44. The housing part 41 houses the rotation shaft 32*a* of the retard roller 32 inside, and supports the rotation shaft 32*a* in a rotatable manner.

The rotation shaft 32*a* protrudes from the housing part 41 to one side A' in the axial direction. The retard roller 32 is disposed at an end of the rotation shaft 32*a* on the one side A' in the axial direction.

A rocking axis 42 is formed at an end of the housing part 41 on a downstream side B in the sheet conveying direction. The rocking axis 42 extends in parallel to the rotation shaft 32*a*. The housing part 41 is supported in a rockable manner, so that an end thereof on an upstream side B' in the sheet conveying direction can move in an up and down direction about the rocking axis 42. In other words, the retaining member 40 retains the retard roller 32 so that it can contact or separate from the feed roller 31. In addition, the retaining member 40 is supported in a rockable manner about the rocking axis 42 extending in parallel to the rotation shaft 32*a* of the retard roller 32. Note that the retard roller 32 is disposed outside the housing part 41 in this embodiment, but it may be disposed inside the housing part 41.

The first pushed piece 43 protrudes to the upstream side B' in the sheet conveying direction from an outer circumference surface of the housing part 41, at the end of the housing part 41 on the one side A' in the axial direction (see FIG. 2). The first pushed piece 43 is biased by the pushing mechanism 60 in a direction approaching the feed roller 31 (in an upward direction in this embodiment).

The second pushed piece 44 protrudes to the upstream side B' in the sheet conveying direction from the outer circumference surface of the housing part 41, at the end of the housing part 41 on the other side A in the axial direction (see FIG. 2). The second pushed piece 44 is biased by the separation mechanism 70 in a direction separating from the feed roller 31 (a downward direction in this embodiment).

The pushing mechanism 60 includes a pushing member 61, a first biasing member 62, and a connecting member 63.

The pushing member 61 is disposed on the lower side of the first pushed piece 43 (the opposite side to the feed roller 31 with respect to the retaining member 40). The pushing member 61 includes a rotating part 61*a*, a pushing piece 61*b*, and an engaging piece 61*c*.

The rotating part 61*a* is supported in a rotatable manner by a rotation shaft 61*d* extending in the sheet conveying direction (BB' direction). The pushing piece 61*b* and the engaging piece 61*c* protrude from the outer circumference surface of the rotating part 61*a*.

The pushing piece 61*b* and the engaging piece 61*c* are disposed with a predetermined distance therebetween in the circumferential direction of the rotation shaft 61*d*. The first pushed piece 43 is disposed between the pushing piece 61*b* and the engaging piece 61*c*. In this case, the pushing piece 61*b* is positioned closer to a third direction side C3 than the first pushed piece 43 (on the clockwise direction side viewed from the upstream side B' in the sheet conveying direction). In other words, the first pushed piece 43 faces the pushing piece 61*b*. On the other hand, the engaging piece 61*c* is positioned closer to a fourth direction side C4 than the first pushed piece 43 (on the counterclockwise direction side viewed from the upstream side B' in the sheet conveying direction).

The first biasing member 62 is constituted of a helical compression spring and extends in parallel to the axial direction of the rotation shaft 32*a* (an AA' direction). An end of the first biasing member 62 on the one side A' in the axial direction is fixed to the engaging piece 61*c*. An end of the first biasing member 62 on the other side A in the axial direction is connected to the main body of the image forming apparatus 100 other than the sheet feeding device 50, via the connecting member 63.

The separation mechanism 70 is disposed in the cassette storage part 101, and it includes a lever 71 and a second biasing member 72.

The lever 71 is disposed at the end of the housing part 41 on the other side A in the axial direction, on the upstream side B' in the sheet conveying direction. The lever 71 is disposed outside a sheet passing area. The lever 71 is formed in a plate-like shape. The lever 71 is supported in a rotatable manner by a rotation shaft 74 extending in the up and down direction.

An end 71*a* of the lever 71 on the one side A' in the axial direction faces the second pushed piece 44 in the sheet conveying direction (the BB' direction). An end 71*b* of the lever 71 on the other side A in the axial direction faces a side wall 10*a* of the sheet feed cassette 10 in the sheet conveying direction (the BB' direction).

The second biasing member 72 is constituted of a helical spring, and is attached to the rotation shaft 74 of the lever 71. The second biasing member 72 biases the lever 71 in a first direction C1 (the counterclockwise direction viewed from above).

The lever 71 rotates between a working position and a non-working position. Specifically, the lever 71 rotates to be positioned at the working position in a state where the sheet feed cassette 10 is not mounted to the cassette storage part 101, and positioned at the non-working position in a state where the sheet feed cassette 10 is mounted to the cassette storage part 101.

In the working position, the lever 71 rotates in the first direction C1 by a biasing force of the second biasing member 72. In this case, the end 71*a* of the lever 71 on the one side A' in the axial direction contacts with the second pushed piece 44. With the biasing force of the second biasing member 72, the lever 71 pushes the retaining member 40 so as to allow the retard roller 32 to separate from the feed roller 31. In this way, the nip between the retard roller 32 and the feed roller 31 is released.

When the lever 71 is at the working position, the retaining member 40 is biased by the lever 71 that is biased by the second biasing member 72, in the direction where the second pushed piece 44 separates from the feed roller 31, so as to rock and move to the retract position. In this case, the biasing force of the second biasing member 72 is larger than a biasing force of the first biasing member 62. In other words, a pushing force of the lever 71 against the second pushed piece 44 is larger than a pushing force of the pushing piece 61*b* against the first pushed piece 43, and the retaining member 40 rocks and moves to the retract position against the biasing force of the first biasing member 62.

The retaining member 40 is restricted from moving further than the retract position in the direction separating from the feed roller 31. Therefore, the rocked and moved state at the retract position by the biasing force of the second biasing member 72 is maintained. Thus, the state where the nip between the retard roller 32 and the feed roller 31 is released is maintained.

In other words, in the state where the sheet feed cassette 10 is not mounted to the cassette storage part 101, the lever 71 is positioned at the working position, and the retaining member 40 is positioned at the retract position.

On the other hand, in the non-working position, the end 71*b* of the lever 71 on the other side A in the axial direction contacts with the side wall 10*a* of the sheet feed cassette 10. In this case, the lever 71 is pushed to the sheet feed cassette 10 in a second direction C2 (in the clockwise direction viewed from above), so as to rotate against the biasing force of the second biasing member 72. In this way, the end 71*a* of the lever 71 on the one side A' in the axial direction separates from the retaining member 40, and pushing of the lever 71 against the retaining member 40 is released.

When the lever 71 is in the non-working position, the retaining member 40 is biased by the pushing piece 61*b* that is biased by the first biasing member 62, in the direction where the first pushed piece 43 approaches the feed roller 31 (in the upward direction in this embodiment), so as to rock and move to the push contact position. In this case, the retard roller 32 is pushed to contact with the feed roller 31 at a predetermined push contact force.

In other words, in the state where the sheet feed cassette 10 is mounted to the cassette storage part 101, the lever 71 is positioned at the non-working position, and the retaining member 40 is positioned at the push contact position.

As illustrated in FIG. 4, in a plane perpendicular to the rotation shaft 32*a* of the retard roller 32, it is preferred that a pushing direction F1, in which the pushing piece (recess) 61*b* in the push contact position pushes the first pushed piece 43 (the retaining member 40), should form an angle θ1 of 45 degrees or less with a straight line L1 that connects the center of the rotation shaft 32*a* of the retard roller 32 and the center of the rotation shaft 31*a* of the feed roller 31.

When the pushing direction F1 is parallel to the straight line L1 (when the angle θ1 is 0 degrees), the push contact force of the retard roller 32 against the feed roller 31 can be most stabilized. Therefore, when the first pushed piece 43 is pushed by the pushing piece (recess) 61*b* so that the angle θ1 between the pushing direction F1 and the straight line L1 becomes close to zero, the biasing force of the first biasing member 62 can be efficiently transmitted to the retaining member 40. In this way, the push contact force of the retard roller 32 against the feed roller 31 can be stabilized, and occurrence of a sheet conveyance error can be suppressed.

Note that when the pushing direction F1 is parallel to a tangent direction F2 at a tangent point P of a circle whose center is the rocking axis 42, the biasing force of the first biasing member 62 can be most efficiently transmitted to the retaining member 40. For this reason, it is preferred that the pushing direction F1 should form an angle of 45 degrees or less with the tangent direction F2 at the tangent point P of the circle whose center is the rocking axis 42.

On the other hand, as the angle θ1 between the pushing direction F1 and the straight line L1 becomes larger, a component of the pushing force of the pushing piece (recess) 61*b* in the tangent direction F2 becomes smaller. In this way, the biasing force of the first biasing member 62 transmitted to the retaining member 40 is decreased. Therefore, if the angle θ1 is larger than 45 degrees, the push contact force of the retard roller 32 against the feed roller 31 becomes unstable.

Note that the embodiment disclosed this time is an example in every aspect and should not be interpreted as a limitation. The scope of the present disclosure is defined not by the above description of the embodiment but by the claims, and should be understood to include all modifications within meaning and scope equivalent to the claims.

For instance, in the embodiment described above, the attachment and detachment direction of the sheet feed cassette 10 with respect to the main body of the image forming apparatus 100 is perpendicular to the sheet conveying direction (the BB' direction) as an example, but the present disclosure is not limited to this. The present disclosure can also be applied to a sheet feed cassette whose attachment and detachment direction with respect to the main body of the image forming apparatus 100 is parallel to the sheet conveying direction (the BB' direction). In addition, the first biasing member 62 extends in parallel to the rotation shaft 32*a* of the retard roller 32 in this embodiment, but it may extend perpendicularly to the rotation shaft 32*a* as long as the rotating part 61*a* can be biased and rotated.

The invention claimed is:

1. A sheet feeding device comprising:

a cassette storage part;

a sheet feed cassette mounted to the cassette storage part in an attachable and detachable manner;

a pickup roller that contacts with a sheet stored in the sheet feed cassette so as to send out the sheet;

a feed roller that conveys the sheet sent out by the pickup roller;

a retard roller that is pushed to contact with the feed roller so as to form a nip part, and conveys the sheet while separating the sheets;

a retaining member that retains the retard roller so that the retard roller can contact or separate from the feed roller; and a pushing mechanism that pushes the retaining member so that the retard roller is pushed to contact with the feed roller, wherein the retaining member is supported in a rockable manner about a rocking axis extending in parallel to a rotation shaft of the retard roller, the retaining member is positioned at a retract position where the retard roller is separated from the feed roller, in a state where the sheet feed cassette is drawn out from the cassette storage part, while the retaining member is positioned at a push contact position where the pushing mechanism allows the retard roller to be pushed to contact with the feed roller, in a state where the sheet feed cassette is mounted to the cassette storage part, the pushing mechanism includes a pushing member that contacts and pushes the retaining member, and a first biasing member that biases the pushing member, and in a plane perpendicular to the rotation shaft of the retard roller, a pushing direction of the pushing member in the push contact position against the retaining member forms an angle of 45 degrees or less, with a straight line connecting the center of the rotation shaft of the retard roller and the center of a rotation shaft of the feed roller.

2. The sheet feeding device according to claim 1, further comprising a separation mechanism that pushes the retaining member so as to allow the retard roller to separate from the feed roller, wherein the separation mechanism is disposed in the cassette storage part, and includes a lever supported in a rotatable manner corresponding to attachment or detachment of the sheet feed cassette, so as to push the retaining member, and a second biasing member that biases the lever, the lever rotates to be positioned at a working position in a state where the sheet feed cassette is not mounted to the cassette storage part, and positioned at a non-working position in a state where the sheet feed cassette is mounted to the cassette storage part, in the working position, the lever pushes the retaining member so as to allow the retard roller to separate from the feed roller, with a biasing force of the second biasing member, and in the non-working position, the lever is pushed by the sheet feed cassette, so as to separate from the retaining member against the biasing force of the second biasing member, and releases pushing of the retaining member.

3. The sheet feeding device according to claim 2, wherein the pushing member includes a rotating part supported in a rotatable manner by a rotation shaft extending in a sheet conveying direction, and an engaging piece and a pushing piece that protrude from an outer circumference surface of the rotating part and are arranged in a circumferential direction, the first biasing member has an end engaged with the engaging piece, so as to bias and rotate the pushing piece, the retaining member includes a first pushed piece that protrudes in the sheet conveying direction so as to face the pushing piece, and a second pushed piece that faces the lever, when the lever is in the non-working position, the retaining member is biased by the pushing piece that is biased by the first biasing member, in the direction where the first pushed piece approaches the feed roller, so as to rock and move to the push contact position, and when the lever is in the working position, the retaining member is biased by the lever that is biased by the second biasing member, in the direction where the second pushed piece separates from the feed roller, so as to rock and move to the retract position.

4. An image forming apparatus comprising:

the sheet feeding device according to claim 1; and an image forming unit that forms an image on a sheet.

* * * * *